United States Patent [19]

Shaffer, Jr. et al.

[11] Patent Number: 4,543,468

[45] Date of Patent: Sep. 24, 1985

[54] CONTROL SYSTEM FOR WATER HEATER WITH EXTERNAL HEAT SOURCE

[75] Inventors: Jacob E. Shaffer, Jr.; John C. Reier; Frederick C. Tome, Jr., all of York, Pa.

[73] Assignee: Borg-Warner Corporation, Chicago, Ill.

[21] Appl. No.: 450,499

[22] Filed: Dec. 16, 1982

[51] Int. Cl.[4] ..... H05B 1/02; F24J 3/04; F25B 29/00; F24H 1/20

[52] U.S. Cl. ..... 219/279; 62/238.6; 62/238.7; 126/351; 126/427; 165/29; 219/312; 219/328; 219/331; 237/2 B

[58] Field of Search ..... 219/279, 331, 328, 312, 219/316; 237/2 B; 62/238.6, 238.7; 165/29; 126/351, 361, 362, 427

[56] References Cited

U.S. PATENT DOCUMENTS

| | | | |
|---|---|---|---|
| 1,874,803 | 8/1932 | Reed | 62/238.6 |
| 2,095,017 | 10/1937 | Wilkes et al. | 165/29 X |
| 3,017,162 | 1/1962 | Haines et al. | 62/238.6 |
| 4,073,285 | 2/1978 | Wendel | 62/238.6 |
| 4,330,309 | 5/1982 | Robinson | 62/238.6 |

FOREIGN PATENT DOCUMENTS 3048644 7/1982 Fed. Rep. of Germany ..... 237/2 B

*Primary Examiner*—A. Bartis
*Attorney, Agent, or Firm*—Julian Schachner

[57] ABSTRACT

A control system for an electric domestic water heater operatively associated with an external heat source, such as a heat pump, and including a water storage tank having an internal electric heater unit controlled by a tank thermostat responsive to the water temperature in the tank. The control system maintains the tank heater unit effectively turned off and turns the external heat source on in response to an indication from the tank thermostat that there is a demand for hot water. The control system turns the external heat source off in response to an indication from the tank thermostat that the demand for hot water has been satisfied. The control system may include devices, such as an evaporator thermostat, high pressure cut-out switch, etc., indicative of the condition of the external heat source for turning the external heat source off, turning the tank heater unit on and maintaining the tank heater unit on until the demand for hot water has been satisfied. The tank heater unit and tank thermostat need not be rewired for use with the control system.

20 Claims, 4 Drawing Figures

CONTROL SYSTEM FOR WATER HEATER WITH EXTERNAL HEAT SOURCE

BACKGROUND OF THE INVENTION

This invention relates generally to a control system for a water heater with an external heat source. More particularly, it is directed to a control system for a conventional domestic hot water heater used in association with an external heat source in the form of a heat pump or the like.

A conventional domestic hot water heater typically includes an internal heat source in the form of a tank heating unit having a heating element and a tank thermostat. When the thermostat indicates a demand for hot water, the heating element is turned on. When the thermostat indicates that the demand for hot water has been satisfied, the heating element is turned off.

The heat pump has been known for many years. Although it is more economical to operate than a conventional tank heating unit, it has not been used extensively heretofore because power, particularly electric power, has been inexpensive. As the cost of power increases, there is renewed interest in the use of a heat pump in association with a water heater, particularly for providing domestic hot water.

When a heat pump is provided for use with a hot water heater, it would be advantageous if its control system were responsive to the tank thermostat as an indicator of the demand for hot water. Such an arrangement is disclosed in copending U.S. application Ser. No. 640,891 filed Aug. 14, 1984, which is a continuation of U.S. application Ser. No. 416,435 filed Sept. 10, 1982 now abandoned. This application is of common assignee herewith, and is incorporated herein by reference. A problem with this arrangement is that it requires that the tank heating unit be rewired. This would be acceptable in an equipment package for the new construction market. However, it would not be acceptable in an aftermarket package for on-site installation in association with a conventional domestic hot water heater. The problem is that rewiring the tank heating unit in the field would negate the Underwriters Laboratories approval.

Without modification of the tank heating unit, the water pump within the heat pump could be cycled on periodically, and a measurement could be taken of the temperature in a line communicating the hot water tank with the heat pump. The problem with this, however, is that it would shorten the working life of the water pump.

A different problem may occur when a heat pump is provided for use with a hot water heater. There may be occasions when an external condition would render the heat pump ineffective and/or inefficient. Such an external condition might be, for example, the formation of frost on the evaporator of the heat pump, in which case its heating capacity would not remain adequate to meet the hot water requirements.

One solution would be to provide the heat pump with a defrosting capability. However, the problem here is that this would add significantly to the cost.

Another solution is disclosed in the aforementioned U.S. application Ser. No. 640,891 wherein an evaporator thermostat is provided, and wherein the heat pump is turned off and the tank heating unit is turned on when a frost condition at the evaporator is indicated. Again, however, this arrangement requires that the tank heating unit be rewired, and thus would negate the Underwriters Laboratories approval.

There remains a need in the art for a control system for a hot water heater with an external heat source, which system is conducive to installation on-site without modification of the existing hot water heater, and which will solve the problems noted above.

SUMMARY OF THE INVENTION

The object of this invention is to meet this need. To that end, there is disclosed a hot water supply system in the form of a conventional domestic hot water heater and an external heat source in the form of a heat pump. When there is a demand for hot water, the heat pump is cycled on. When the demand for hot water has been satisfied, the heat pump is cycled off automatically. If some external condition is sensed, such as a frost condition at the evaporator, the heat pump is turned off and the tank heating unit is turned on automatically. This prevails until the demand for hot water has been satisfied, at which time the tank heating unit is turned off and the system is recycled to its original condition. This is accomplished without modification of the tank heating unit.

The tank heating unit of the hot water supply system is not modified, but nevertheless its tank thermostat is used as an indicator of the demand for hot water. The control system of this invention is actuated in response to this indication for controlling both the external heat source and the tank heating unit.

In summary, this invention is directed to a control system for a water heater operatively associated with an external heat source, wherein the water heater includes a water storage tank having a tank heating unit. The control system maintains the tank heating unit effectively turned off and turns the external heat source on in response to an indication from the tank heating unit that there is a demand for hot water. The control system also turns the external heat source off in response to an indication from the tank heating unit that the demand for hot water has been satisfied. Further, the control system is responsive to an external condition for turning the external heat source off, turning the tank heating unit on, and maintaining the external heat source off and the tank heating unit on until the tank heating unit indicates that the demand for hot water has been satisfied.

BRIEF DESCRIPTION OF THE DRAWING

The objects and advantages of this invention will become apparent to those skilled in the art upon careful consideration of the specification herein, including the drawing, wherein.

Figure 1:
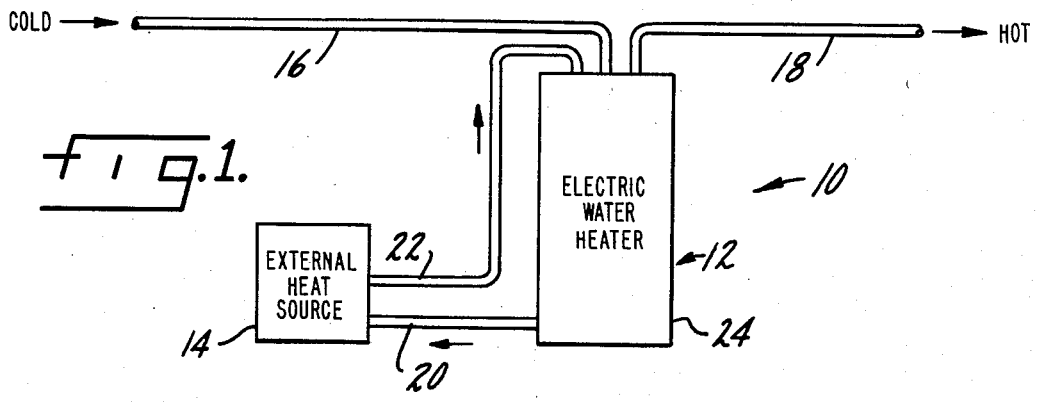
FIG. 1 is a piping diagram of a typical domestic hot water heater with an external heat source.

While this invention is susceptible of embodiment in many different forms, a preferred embodiment is shown in the drawing and described in detail. It should be understood that the present disclosure is considered to be an exemplification of the principles of the invention, and is not intended to limit the invention to this embodiment.

DESCRIPTION OF A PREFERRED EMBODIMENT

Turning now to the drawing in greater detail, in FIG. 1 reference numeral 10 designates generally a hot water heater with an external heat source. In a preferred form of the invention, this includes a conventional domestic hot water heater 12 and a heat pump 14. Water heater 12 and heat pump 14 may be of the type disclosed in detail in the aforementioned U.S. application Ser. No. 640,891.

An inlet water line 16 directs cold make-up water to water heater 12. An outlet water line 18 supplies hot water to the user. A suitable line 20 is provided to direct water from water heater 12 to heat pump 14. Similarly, a suitable line 22 is provided to direct heated water from heat pump 14 to water heater 12. This arrangement is disclosed in detail in the aforementioned U.S. application Ser. No. 416,435.

Figure 2:
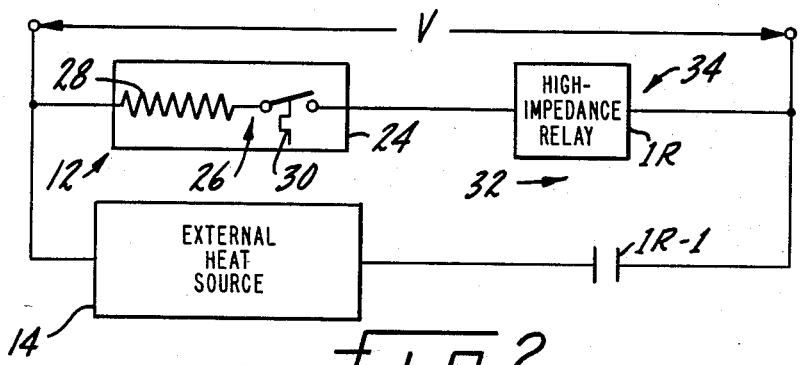
FIG. 2 is a schematic diagram showing the control system in its basic form.

As shown in FIG. 2, heater 12 includes a hot water supply tank 24 having a tank heating unit 26 which includes one or more heating elements, generally designated by reference numeral 28, connected in series with one or more tank thermostats, generally designated by reference numeral 30. Heater 12 is used, without modification, in association with heat pump 14, and both are under the control of a control system 32.

In its basic form, control system 32 includes first control means 34 in the form of a high-impedence relay 1R with a normally open contact 1R-1. Tank heating unit 26 is connected in series with high-impedence relay 1R across a suitable source of line voltage V. The impedence of relay 1R is significantly higher than that of heating element 28. Also connected in series across line voltage V are heat pump 14 and relay contact 1R-1.

A demand for hot water in tank 24 is indicated when thermostat 30 closes, thereby energizing high-impedence relay 1R. This closes relay contact 1R-1, turning on heat pump 14. The amount of heat developed by heating element 28 will be negligible, as it is in series with the high-impendence represented by relay 1R. Heating element 28 is effectively maintained in an off condition, with heat being supplied by heat pump 14.

This condition will prevail until thermostat 30 opens, indicating that the demand for hot water in tank 24 has been satisfied. Relay 1R will be de-energized, and the system will be cycled off.

Figure 3:
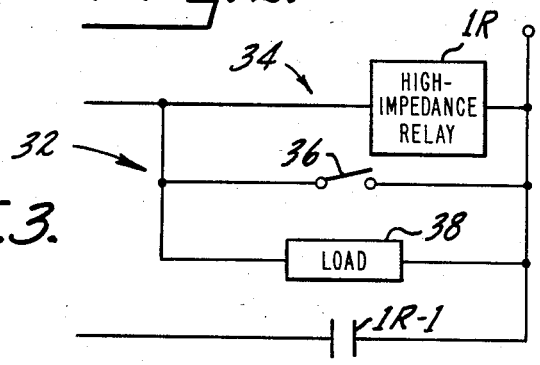
FIG. 3 is a partial schematic diagram showing optional features of the control system in its basic form.

Turning now to FIG. 3, there are shown two optional features, either or both of which may be incorporated in the control system. One feature is in the form of a suitable on-off switch 36 connected in parallel with relay 1R. Switch 36, which may be of the manual type or may be some automatic switching device, is normally open. When it is closed it provides a low-impedence path around relay 1R, such that relay 1R will not be energized when thermostat 30 closes. In this event, water in tank 24 will be heated by heating element 28 in the conventional manner.

The other optional feature is the connection of a suitable load 38 in parallel with relay 1R. Such a load might be, for example, the pump or fan motor of heat pump 14. Load 38 is provided to insure that sufficient current is drawn across thermostat 30 to overcome the effect of oxidation on its contacts. Load 38 may be needed, as relay 1R typically would have a low current draw.

An important feature of this invention is that thermostat 30 of tank heating unit 26 indicates the demand for hot water, and control system acts in response thereto. This is accomplished without modification of heater 12, and thus without negating the Underwriters Laboratories approval.

Figure 4:
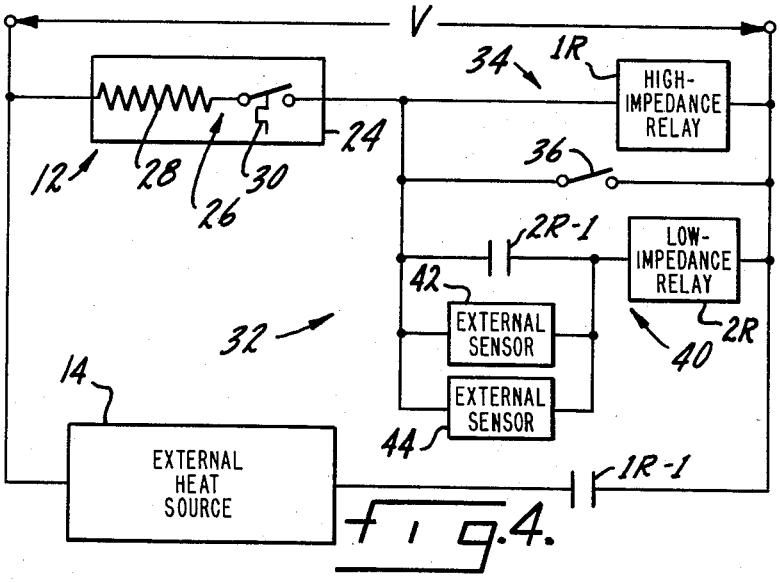
FIG. 4 is a schematic diagram showing details of the control system as applied to a typical domestic hot water heater with an external heat source.

Control system 32 may be expanded to include additional automatic control and/or safety devices. As shown in FIG. 4, second control means 40 includes a low-impedence, current sensing relay 2R in series with a normally open contact 2R-1. Relay 2R and relay contact 2R-1 are connected in parallel with relay 1R. When relay 2R is energized, relay contact 2R-1 will close and shunt out relay 1R. Relay 1R will be de-energized, opening relay contact 1R-1 and turning off heat pump 14. As relay 2R is a low-impedence device, heating element 28 will be turned on, and water in tank 24 will be heated thereby. Relay 2R may be replaced by a solid state device capable of sensing a range of currents, depending upon the size of heater element 28.

Various automatic control and/or safety devices may be connected in parallel with relay contact 2R-1. Such devices may include an evaporator thermostat 42 of the type disclosed in detail in the aforementioned U.S. application Ser. No. 416,435. Additional devices may include a high pressure cut-out switch 44. As shown in FIG. 4, these devices are normally open, and close when a particular external condition is sensed.

The operating cycle is initiated when tank thermostat 30 closes, indicating a demand for hot water in tank 24. In response thereto relay 1R is energized, closing relay contact 1R-1 and turning on heat pump 14. As noted, due to the fact that relay 1R is a high-impedence device, negligible current will flow through heating element 28. Thus, heating element 28 is maintained effectively off. Under normal conditions this prevails until tank thermostat 30 opens, indicating that the demand for hot water in tank 24 has been satisfied. At this point relay 1R will be de-energized, opening relay contact 1R-1 and concluding the operating cycle.

If during normal operation an abnormal condition is sensed by one of devices 42 or 44, that device will close. Current will flow through relay 2R, and relay contact 2R-1 will close. Once this has taken place, relay contact 2R-1 will remain closed even if device 42 or 44 should open. As relay 2R has a low-impedence, relay 1R is de-energized, heat pump 14 is turned off, and heat for the water in tank 24 is provided by heating element 28. Heat pump 14 remains off. This condition prevails until tank thermostat 30 indicates the desired tank water temperature, at which time relay contact 2R-1 opens and the operating cycle is concluded.

When there is again a demand for hot water, a new operating cycle will be initiated. Heat will be provided by heat pump 14 unless an abnormal condition again is sensed by one of devices 42 or 44.

It will be apparent to those skilled in the art that the invention disclosed herein provides a simple, efficient, easily constructed and installed control system for a water heater with an external heat source. The heater is readily adaptable for production either as an equipment package for the new construction market or as an after-market package for on-site connection to a typical domestic hot water heater.

An important advantage of this invention is that it may be used in conjunction with a conventional domestic hot water heater without modification thereof, and thus without voiding the Underwriters Laboratories approval. All that is required is a connection of the external power leads of the hot water heater to the control system disclosed herein.

It should be understood that while a preferred embodiment of this invention has been shown and described, it is to be considered as illustrative and may be modified by those skilled in the art. It is intended that the claims herein cover all such modifications as may fall within the spirit and scope of the invention.

What is claimed is:

1. In a control system for controlling the heating operation of a water heater operatively associated with an external heat source, said water heater including a water storage tank having an internal tank heating unit and a tank thermostat; the improvement wherein said control system comprises first means for both maintaining said tank heating unit effectively turned off and turning said external heat source on in response to an indication from said tank thermostat that there is a demand for hot water in said tank, said first means turning said external heat source off in response to an indication from said tank thermostat that the demand for hot water in said tank has been satisfied.

2. The control system of claim 1, further comprising second means responsive to at least one external condition for overriding said first means and turning said external heat source off, turning said tank heating unit on, and maintaining said external heat source off and said tank heating unit on until said tank thermostat indicates that the demand for hot water in said tank has been satisfied.

3. In a control system for controlling the heating operation of a water heater operatively associated with an external heat source, said water heater including a water storage tank, and an internal tank heating unit having at least one heating element connected in series with at least one tank thermostat; the improvement wherein said control system comprises first means external to said tank heating unit for maintaining said at least one heating element effectively off and turning said external heat source on in response to an indication from said at least one tank thermostat that there is a demand for hot water in said tank, said first means also turning said external heat source off in response to an indication from said at least one tank thermostat that the demand for hot water in said tank has been satisfied.

4. The control system of claim 3, further comprising second means external to said tank heating unit and responsive to at least one external condition for overriding said first means and turning off said external heat source, turning on said at least one heating element, and maintaining said external heat source off and said at least one heating element on until said at least one tank thermostat indicates that the demand for hot water in said tank has been satisfied.

5. The control system of claim 4, said first means including a high-impedence relay having a normally open contact, said high-impedence relay being connected in series with said tank heating unit across a voltage source, and said high-impedence relay contact being connected in series with said external heat source across a voltage source.

6. The control system of claim 5, further comprising on-off switching means connected in parallel with said high-impedence relay, the impedence of said switching means being negligible.

7. The control system of claim 5, further comprising a load connected in parallel with said high-impedence relay, the impedence of said load being low enough to draw current across said at least one tank thermostat irrespective of oxidation thereon, but high enough to cause negligible heating by said at least one one heating element.

8. The control system of claim 7, said load including at least part of said external heat source.

9. The control system of claim 5, said second means including a low-impedence relay in series with a normally open contact, said low-impedence relay and low-impedence relay contact being connected in parallel with said high-impedence relay, and at least one external condition sensing device, each device being connected in series with said low-impedence relay and in parallel with said low-impedence relay contact.

10. The control system of claim 9, said external heat source including a heat pump having an evaporator, and said external condition sensing device including an evaporator thermostat.

11. The control system of claim 9, said external heat source including a heat pump having a compressor, and said external condition sensing device including a compressor high pressure cut-out switch.

12. The control system of claim 9, said external heat source including a heat pump having an evaporator and a compressor, and said external condition sensing devices including an evaporator thermostat and a compressor high pressure cut-out switch.

13. The control system of claim 3, said first means including a high-impedence relay having a normally open contact, said high-impedence relay being connected in series with said tank heating unit across a voltage source, and said high-impedence relay contact being connected in series with said external heat source across a voltage source.

14. The control system of claim 13, further comprising on-off switching means connected in parallel with said high-impedence relay, the impedence of said switching means being negligible.

15. The control system of claim 13, further comprising a load connected in parallel with said high-impedence relay, the impedence of said load being low enough to draw current across said at least one tank thermostat irrespective of oxidation thereon, but high enough to cause negligible heating by said at least one heating element.

16. The control system of claim 15, said load including at least part of said external heat source.

17. The control system of claim 13, said second means including a low-impedence relay in series with a normally open contact, said low-impedence relay and low-impedence relay contact being connected in parallel with said high-impedence relay, and at least one external condition sensing device, each device being connected in series with said low-impedence relay and in parallel with said low-impedence relay contact.

18. The control system of claim 13, said external heat source including a heat pump having an evaporator, and said external condition sensing device including an evaporator thermostat.

19. The control system of claim 17, said external heat source including a heat pump having a compressor, and said external condition sensing device including a compressor high pressure cut-out switch.

20. The control system of claim 17, said external heat source including a heat pump having an evaporator and a compressor, and said external condition sensing devices including an evaporator thermostat and a compressor high pressure cut-out swtich.

* * * * *

UNITED STATES PATENT OFFICE

CERTIFICATE OF CORRECTION

PATENT NO. : 4,543,468

DATED : September 24, 1985

INVENTOR(S) : JACOB E. SHAFFER JR., JOHN C. REIER and FREDERICK C. TOME JR.

It is certified that error appears in the above-identified patent and that said Letters Patent are hereby corrected as shown below:

Column 6, line 55, cancel "13" and insert -- 17, --.

Signed and Sealed this

Twenty-sixth Day of November 1985

[SEAL]

Attest:

DONALD J. QUIGG

Attesting Officer

Commissioner of Patents and Trademarks